United States Patent [19]

Boeckmann et al.

[11] Patent Number: 4,669,617

[45] Date of Patent: Jun. 2, 1987

[54] PEN HOLDER DEVICE

[75] Inventors: Juergen Boeckmann, Tangstedt-Rade; Bernhard Bruhn, Halstenbek; Harald Hofmann, Hartenholm; Anke Hoejer; Axel Mikuteit, both of Hamburg; Hans-Joachim Ritter; Rolf Tenhagen, both of Kisdorf, all of Fed. Rep. of Germany

[73] Assignee: Koh-I-Noor Rapidograph, Inc., Bloomsbury, N.J.

[21] Appl. No.: 777,801

[22] Filed: Sep. 19, 1985

[30] Foreign Application Priority Data

Sep. 20, 1984 [DE] Fed. Rep. of Germany ..... 3434812

[51] Int. Cl.[4] ..... A47F 7/00

[52] U.S. Cl. ..... 211/69.7; 211/168

[58] Field of Search ..... 211/69.7, 60.1, 69, 211/69.1, 69.5, 69.6, 69.8, 69.9, 168, 170, 96, 99

[56] References Cited

U.S. PATENT DOCUMENTS

| | | | |
|---|---|---|---|
| 1,000,840 | 8/1911 | Pennington | 211/170 X |
| 1,342,364 | 6/1920 | Wikstrom | 211/69 |
| 1,629,574 | 5/1927 | Hanle | 211/69.7 |
| 1,793,910 | 2/1931 | Cuthbert et al. | 211/69.7 |
| 1,795,824 | 3/1931 | Bellavance | 211/69.7 |
| 2,403,825 | 7/1946 | Nissenbaum | 211/69 X |
| 2,907,584 | 10/1959 | Neilsen | 211/69.5 |
| 4,334,622 | 6/1982 | Mutschler | 211/69.5 |
| 4,374,565 | 2/1983 | Newmann | 211/69.5 |
| 4,538,736 | 9/1985 | Berger | 211/69.5 |

FOREIGN PATENT DOCUMENTS

| | | |
|---|---|---|
| 6935126 | 2/1971 | Fed. Rep. of Germany . |
| 1298120 | 11/1972 | United Kingdom . |

*Primary Examiner*—Robert W. Gibson, Jr.
*Assistant Examiner*—Sarah A. Lechok Eley
*Attorney, Agent, or Firm*—David H. Semmes; Warren E. Olsen

[57] ABSTRACT

In a pen holder device, a pen holder body (3) contained in a support body (2) is pivotable between an operational position, which is slightly inclined from the perpendicular, and a generally horizontal readiness position, wherein an acute angle exists between the operational position and the readiness position. Bearing shoulders (15) provided on opposite sides of the pen holder body (3) rest with little friction upon support surfaces (12) having evenly curved surface areas. The center of gravity (21) of the pen holder body (3) alone is below the bearing shoulders (15) and the common center of gravity (20) of the pen holder body (3) and a writing instrument (4) inserted in it is above the bearing shoulders (15).

19 Claims, 11 Drawing Figures

PEN HOLDER DEVICE

BACKGROUND OF THE INVENTION

1. Field of the Invention

The invention relates to a pen holder device having a pen holder body pivotably disposed in a support body between an operational position, slightly inclined from the vertical, and a generally horizontal readiness position, an acute angle obtaining between the latter and the operational position, into which a writing instrument, especially a tube writer, can be inserted from above, the pen holder body having bearing shoulders on opposite sides and the support body having bearing supports which each support a respective bearing shoulder.

2. Description of the Prior Art

In a known pen holder device of this species in the form of a holder for writing instruments (German Utility Model, DE-GM No. 6 935 126/Great Britain Pat. No. GB 1298120) the support body consists of a box and the pen holder body of a lid insert for the box, having a plurality of holders disposed next to each other, and pivotably disposed in the box, so that the inserted writing instruments are contained in the box in the folded-down readiness position and the box is closed by means of the lid disposed on the pen holder body. In the inclined operational position of the pen holder body all holders are situated in such a manner that the writing instruments can be inserted into them or removed from them. To change from the readiness position to the operational position, the user must flip open the pen holder body with all the writing instruments contained therein as well as the lid disposed thereon and flip it back again.

SUMMARY OF THE INVENTION

It is the object of the present invention to provide a pen holder device wherein the respective pen holder body, after a writing instrument has been inserted while in the operational position, automatically returns to the readiness position, so that the inserted writing instruments are normally in the readiness position.

To attain this object, a pen holder device of the above-mentioned species is developed by means of the present invention in such a way that the interaction between the bearing supports and the bearing shoulders in the operational position and the readiness position has low friction and generally takes place solely by means of an evenly curved surface area of the bearing shoulders held by the force of gravity, and in that the center of gravity of the pen holder body lies below the bearing shoulders and the common center of gravity of the pen holder body and the inserted writing instrument lies above the bearing shoulders.

In a pen holder device in accordance with the present invention the pen holder device therefore is supported in the support body in an easily pivotable manner, i.e., in the main it is only supported on the support surface by the evenly curved surface area and does not have a binding or hindering contact with the support surface. Therefore, the position of the pen holder body is determined by the position of its center of gravity. The center of gravity of the pen holder body itself lies below the bearing shoulders; because of this position of the center of gravity as well as because of the low-friction mounting the pen holder body automatically assumes the operational position. However, if a writing instrument is inserted into the pen holder body, the center of gravity of the pen holder body together with the inserted writing instrument lies above the bearing shoulders, so that the pen holder body with the writing instrument automatically is pivoted from the slightly inclined operational position into the readiness position.

In another embodiment of the present invention, the bearing supports may have two support surfaces, which are disposed at a distance from each other in the direction of the longitudinal axis of the pen holder body in its position of readiness; the bearing support then shows two bearing surfaces disposed at a distance for the interaction with one of the respective support surfaces and in which the support for the readiness position is nearer to the upper end of the pen holder body then the support surface for the operating position. Both support surfaces can be separated from one another by a bulge between them.

In a pen holder device embodied in the way described, while the pen holder body is empty and in the operational position, a position is taken up which is in the plane of the longitudinal axis of the pen holder body and/or below which is located the center of gravity of a pen holder body not containing a writing instrument. When the pen holder body has a writing instrument inserted, a tilting into the readiness position takes place on account of the position of the center of gravity above the bearing shoulders. The change from one position to the other is made so that the tilting process can take place without the danger of binding of the supports.

It should be noted that the pen holder body can be moved from the readiness position to the operational position by hand by the user to remove a writing instrument and that the writing instrument can then be taken out of the pen holder body. The empty pen holder body then remains in the operational position.

In a pen holder device with bearing supports for two receiving surfaces and bearing shoulders with two bearing surfaces disposed at a distance from one another, the bearing shoulders can be angular in cross section and the support surfaces can be formed on the free ends of their legs.

The bearing support can be formed by a cutout open at the top in the support body, in the bottom of which the support surface or surfaces are disposed.

So as to clearly define the readiness position and the operational position, a detent or a stop pin can be provided at the bottom end of the pen holder body, which abuts against a detent surface formed on the support body in the operational position or the readiness position, respectively.

To remove the pen holder body from the support body while the pen holder body is in the readiness position, its bearing shoulder can be slightly raised and removed in an axial direction of the pen holder body, so that the stop pin reaches a cutout, open to the top, of the support body, whereby the pen holder body can be moved upwardly out of the support body.

Often a pen holder device in accordance with the present invention is used to transport as well as to keep a writing instrument. For this purpose the support body can be a part of a box-like receiving element having a receiving area for the writing instrument abutting the pen holder body and to which is fastened a lid element capable of being moved between an opening and closing position. In a pen holder device of this kind it is practical for the user to make sure that the pen holder body is only used as a temporary receptable for the writing instrument, while for prolonged storage the writing instrument, such as a tube writer using writing ink or India ink having a tight cap, should be stored in the closed position.

To force the user to store the writing instrument in such a way, the lid element can be pivotable around an axis parallel to the pen holder pivot axis, which is disposed on the end of the pen holder pivot axis away from the receiving area for the writing instrument. In the upper end area of the pen holder body an opening can be provided on the side toward the lid element, while in the plane extending vertically to the pen holder pivot axis of the lid element, which contains the opening, a protrusion is provided which extends, while the lid element is closed, through the opening and the pen holder opening and engages the wall of the pen holder body opposite the opening.

If the lid element is now closed while the pen holder body is empty and therefore in the operational position, the protrusion moves through the opening and engages the wall of the pen holder body opposite the protrusion and thereby moves the pen holder body into the essentially horizontal readiness position and the lid element closes.

If there should be a writing instrument in the pen holder body during such a movement of the lid element, the lid element cannot be closed because the protrusion provided on it cannot engage the wall of the pen holder body opposite the opening, which will remind the user to remove the writing instrument from the pen holder body and to close it tightly with the cap provided.

To show, in such an embodiment, very clearly the presence of a writing instrument in the pen holder body by means of an early blocking of the movement of the lid element into the closed position and so as not to stress the writing instrument during such a movement because of engagement with the protrusion, the opening can consist of a cutout open to the top. During the readiness position of the pen holder the distance of the bottom of the cutout from the axis of the lid element can be smaller than the distance between this axis and the surface section near the bottom of the cutout and oriented toward the axis of the protrusion engaged with the opposite wall of the pen holder, and it can also be greater than the distance of the end portion of the protrusion engaging the opposite pen holder wall. In the operational position the distance of the bottom of the cutout from the axis of the lid element is smaller than the distance of the area of the protrusion oriented towards the axis from the latter.

By means of such a design it is achieved that the protrusion can move, while the pen holder body is in the operational position, (i.e., there is no writing instrument in the pen holder body,) because of the movement of the lid element in the direction of the closing position, through the cutout and into engagement with the opposite wall of the pen holder body, so that the lid element moves the pen holder body into the readiness position and itself arrives in the closed position.

However, if there is a writing instrument in the pen holder body, the latter is in the generally horizontal readiness position and a movement of the lid element in the direction of the closing position does not permit the movement of the protrusion into the cutout of the pen holder body, it touches the outside wall of the pen holder body below the cutout instead; i.e., the lid element is blocked in this position and cannot be moved into the closed position.

Of course, a pen holder device in accordance with the present invention can contain a plurality of pen holder bodies arranged around a common pen holder pivot axis and independently pivotable in the support body.

The invention is described in more detail below by means of the drawing showing exemplary embodiments.

DETAILED DESCRIPTION OF THE PREFERRED EMBODIMENTS

Figure 1:
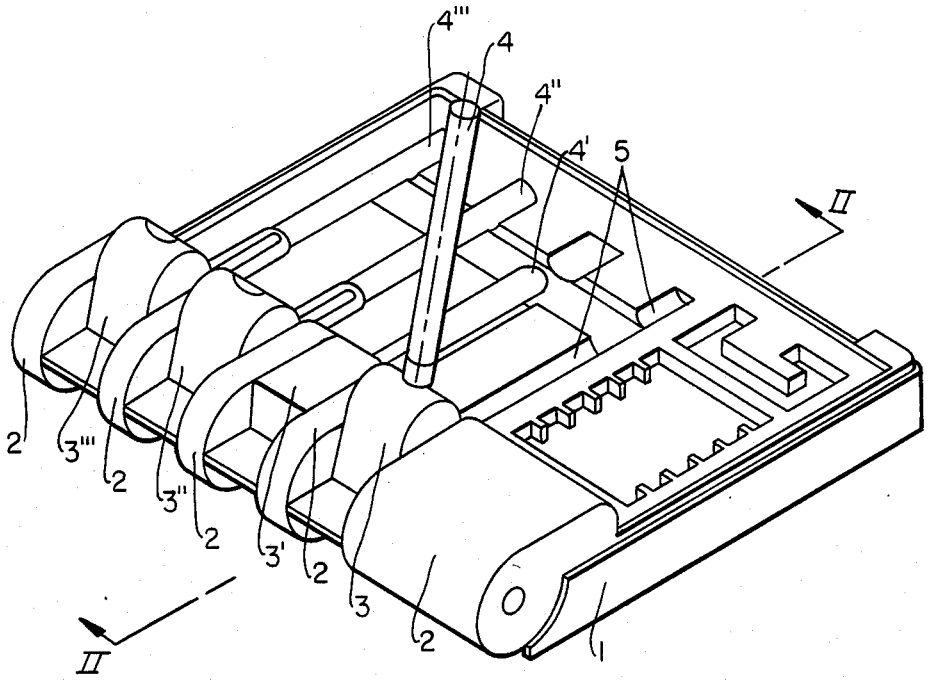
FIG. 1 shows the lower part of a tube writer package with four pen holder devices in perspective.
Figure 8:
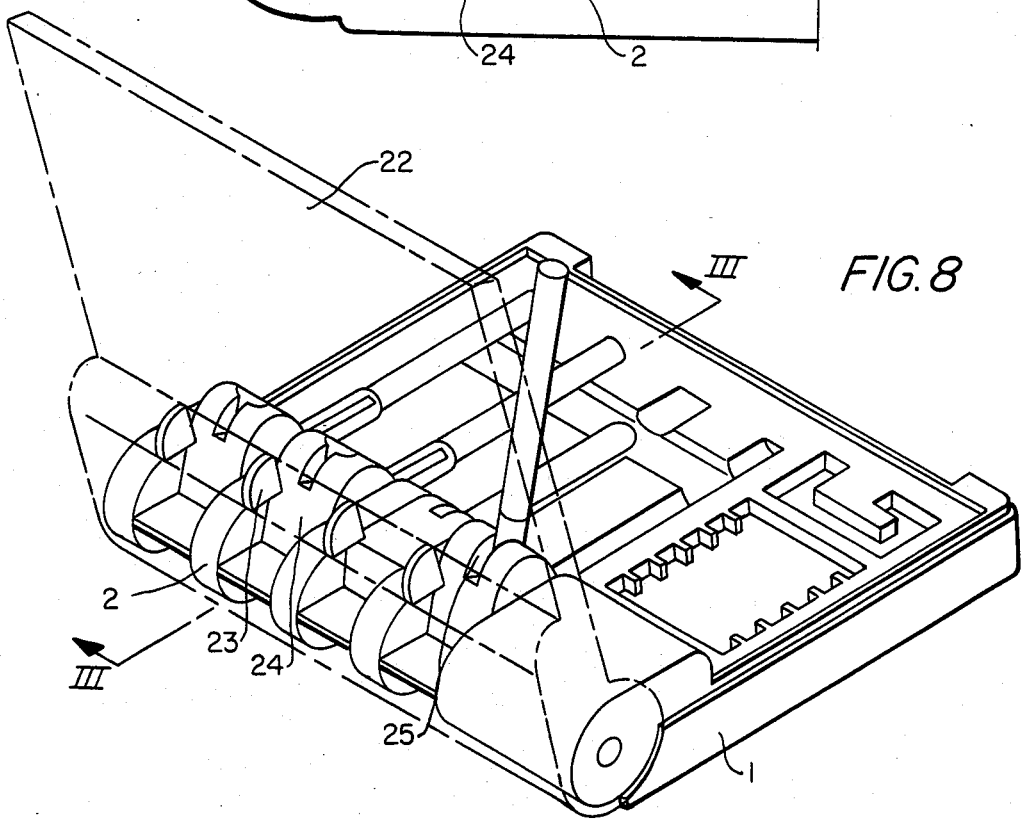
FIG. 8 shows a third embodiment in a perspective view that corresponds to FIG. 1.

The lower part of a tube writer package shown in FIG. 1 consists of a receptable 1, upon which a lid element, (not shown) is to be hinged. FIG. 8 shows how the lid element is to be hinged. The receptacle 1 contains a support body 2 having four reception areas for pen holder bodies 3, 3', 3'' and 3'''. These pen holder bodies are arranged around a common axis independently pivotable and can each hold a tube writer 4, 4', 4'' and 4''', respectively. In the exemplary embodiment shown, the tube writers 4'' and 4''' are disposed in grooves that correspond to the illustrated groove 5 of receptacle 1. This position represents the storage position for the tube writers, wherein they are closed with the customary screw caps. The tube writer 4' is shown inserted into pen holder body 3', which is in its readiness position, while the pen holder body 3 is shown in the operational position. While the tube writer 4 also is shown inserted into pen holder body 3, since the pen holder body 3 has not yet moved into the readiness position (due to the inserted tube writer 4) the insertion of the tube writer 4 has just taken place, and the pen holder body 3 is just moving to the readiness position.

Figure 2:
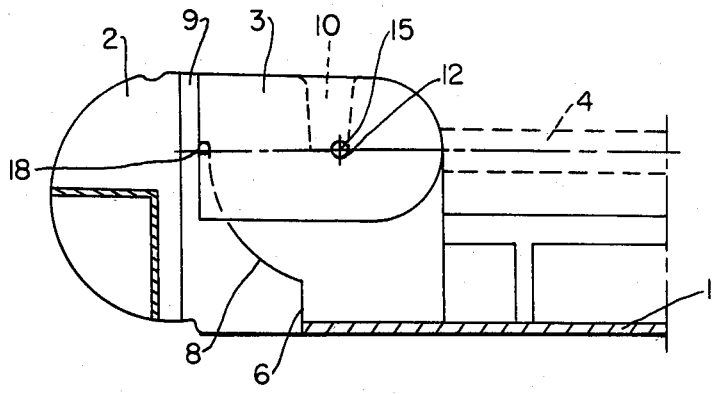
FIG. 2 shows a section along lines II—II of FIG. 1 with the pen holder body in the readiness position.
Figure 3:
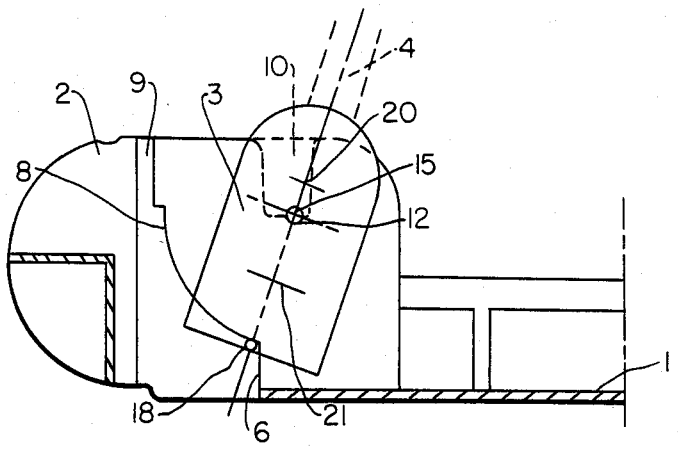
FIG. 3 shows the pen holder body of FIG. 2, but in the operational position.

The section in accordance with FIG. 3 shows the support arrangement of the pen holder body 3 and the support body 2 with the pen holder body 3 in the operational position in accordance with FIG. 1. As can be seen, cutouts open to the top are provided in the support body 2. Of these, only the cutout present on one side of the support body 3 has been shown in FIGS. 2 to 4, while the one on the opposite side, which is formed similarly, has not been shown. An evenly curved support surface 12 is embodied in the bottom of the cutout. The bearing shoulders 15 are provided on opposite sides of the pen holder body 3. They show a circular cross section and are resting, respectively, on the support surface 12 of the support body 2. The diameter of the bearing shoulders 15 has been chosen to be such that the radius of curvature of their circumferential surface is slightly smaller than the radius of curvature of the support surface 12, i.e., the bearing surface shoulder 15 is supported on the support surface 12 without being pinched by it.

In the operational position shown in FIG. 3, the pen holder body 3 is disposed with its central axis oblique to the perpendicular and the operational position is determined by the stop pin 18, disposed on the lower end of the pen holder body 3, abutting against a limiting surface 6 of the support body 2. If no tube writer 4 has been inserted in this position of the pen holder body 3, the center of gravity 21 of the pen holder body 3 is located below the bearing shoulder 15 and below the support surface 12, so that the pen holder 3 remains in the operational position.

When the tube writer 4 is inserted into the pen holder 3, a common center of gravity 20 for the combination of pen holder body 3 and tube writer 4 results, located on the longitudinal axis of the pen holder body 3, but clearly above the bearing shoulder 15 (FIG. 3). Because of this location of the center of gravity and the inclined positiion of the pen holder body 3 in the operational position, the pen holder body 3 and the tube writer 4 contained therein automatically tilt in a clockwise direction (compare FIGS. 2 and 3), while the stop pin 18 moves along the surface 8 until it touches the stop surface 7 disposed on the support body 2 (FIGS. 2 and 4).

To make it possible to remove the tube writer 4, which is in the readiness position according to FIG. 2, from the pen holder body 3, the pen holder body 3 begins to move with any lifting of the tube writer 4. The holder body 3 proceeds to rotate to a position in accordance with FIG. 3, and when the tube writer fully is removed, the pen holder body 3 then remains in that operational position in accordance with FIG. 3.

Figure 4:
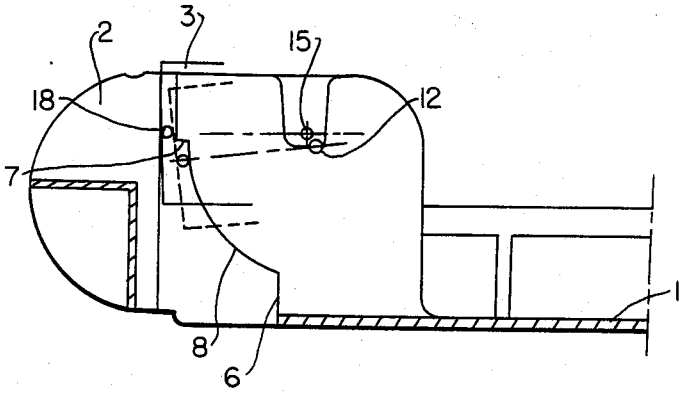
FIG. 4 shows a representation corresponding to FIGS. 2 and 3, but with the pen holder body shown in phantom for a pen holder removal position.

To remove the pen holder body 3 itself from the support body 2, the pen holder body is moved down into the readiness position and the bearing shoulders 15 are lifted from the support surface 12, so that the pen holder body then can be moved slightly to the left (FIG. 4). Consequently, the stop pin 18 is freed from the stop surface 7 and can be moved into the area of a cutout in the support body 2 which is open to the top. In this position the pen holder body 3 can be removed from the support body 2, since the bearing shoulders 15 and the stop pin 18 can be freely moved upwardly and out from the support body 2.

Figure 5:
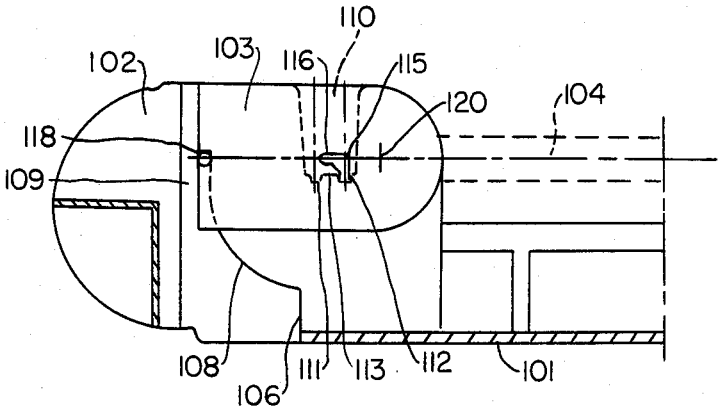
FIGS. 5 to 7 show a second embodiment in representations corresponding to the positions of FIGS. 2 to 4.
Figure 6:
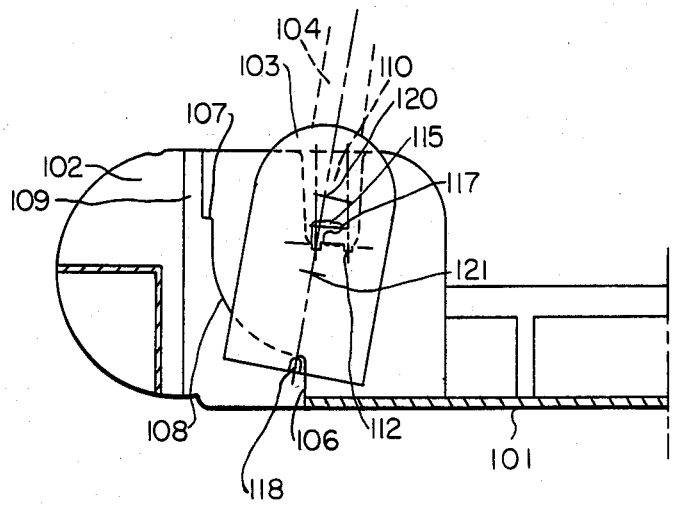
Figure 7:
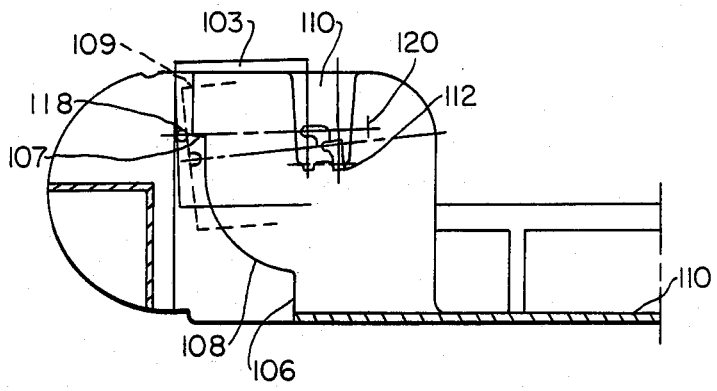

The second preferred embodiment corresponding to FIG. 5–7 largely corresponds to the first embodiment shown in FIGS. 1–4; hence, like or corresponding parts have been given reference numerals that are raised by 100. Parts corresponding in construction and function with those of FIGS. 1–4 will not be described, again.

A pen holder device in accordance with FIGS. 5–7 has a support arrangement that differs from the pen holder of FIGS. 1–4. As shown, in the bottom of the cutout 110 in the support body 102 is formed with two support surfaces—111, 112—between which a raised portion or rib 113 is disposed. The distance between the two support surfaces 111, 112, is equal to the distance between two bearing surfaces 116 and 117 of the bearing shoulder 115 disposed on the pen holder body 103. This bearing shoulder has two legs at right angles to one another, on the free ends of which the bearing surfaces 116 and 117 have been formed. Their shape has been adapted to the shape of the corresponding support surfaces 111, 112, in such a way that the bearing surfaces can move freely and without binding in the support surfaces. In this arrangement, as shown in FIGS. 5 and 6, the bearing surface 116 lies in the plane of the central axis of the pen support body 103.

In the operational position shown in FIG. 6, the bearing surface 116 of the bearing shoulder 115 is engaged with the support surface 111 of the support body 102. The center of gravity 121 of the pen holder body 103 without a writing instrument 104 lies in this operational position below the first bearing surface 116, so that the pen holder body 103 remains in the operational position.

If the writing instrument 104 is inserted into the pen holder body 104, the total of the arrangement of pen holder body 103 and writing instrument 104 results in a common center of gravity 120, lying a distance above the bearing shoulder 115 (FIG. 6) and on the longitudinal axis of the pen holder body 103. By means of this relationship, the pen holder body 103 is tilted into the readiness position, for the reasons described in connection with FIGS. 2 and 3. During this tilting movement the bearing shoulder 115 is moved such that its first bearing surface 116 is freed from the first support surface 111 and its second bearing surface 117 rests on the second support surface 112. The pivot axis of the pen holder body 103 is therefore moved during this operation further to the right; from the operational position in accordance with FIG. 6 to the readiness position, in accordance with FIG. 5.

The return movement of the pen holder body 103 from the readiness position and the removal of the pen holder body 103 from the support body 102 is done in the same manner as described in connection with FIGS. 2 and 3.

The third embodiment shown in FIGS. 8–11 corresponds in part with the basic construction function of the pen holder bodies in the first embodiment of FIGS. 1–4, and like parts have, therefore, been given like reference numerals. The receptacle or box-like reception element 1 is formed in the same manner as shown in FIG. 1 in respect to its receiving area, therefore reference numerals for the grooves to hold the tube writers, or for the various tube writers themselves, have not been repeated in FIG. 8.

The third embodiment of FIGS. 8–11 differs from the first embodiment of FIGS. 1–4 by the illustration of a modified lid element 22 hinged upon the receptacle 1, and by a different shape for the pen holder, 24.

Figure 9:
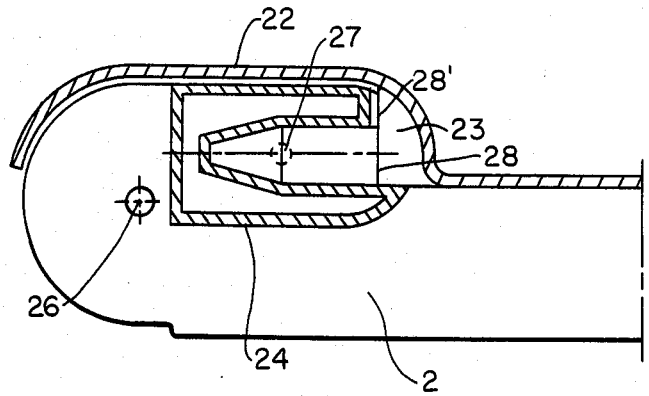
FIGS. 9 to 11 show different positions of the third embodiment pen holder body and the lid element, in section views made along the line III—III of FIG. 8.

As shown in FIGS. 8–11, the lid element 22 is fastened pivotably to the receptacle 1 by a hinge 26. The axis of the hinge 26 runs parallel to the pen holder pivot axis 27, around which the several pen holders are pivotable independently from each other. The hinge 26 also lies further below and to the left on the box-like receptacle 1, than does the pen holder pivot axis 27 (FIG. 9).

The lid is modified by protrusions 23 that are disposed on the inside of the lid element 22, and lie in a plane perpendicular to the hinge 26, and form a right angle between their outside surfaces, 28 and 30. The two outside surfaces 28 and 30 intersect, to form an edge 29.

Each of the pen holders 24 have a cutout 25 that is open to the top on its upper or pen receptacle end, on that side which faces towards the lid element 22. The cutout 25 lies in the plane of a corresponding protrusion 23, and has a width larger than the thickness of the protrusion 23. The cutout terminates as a groove with a bottom 31.

Figure 10:
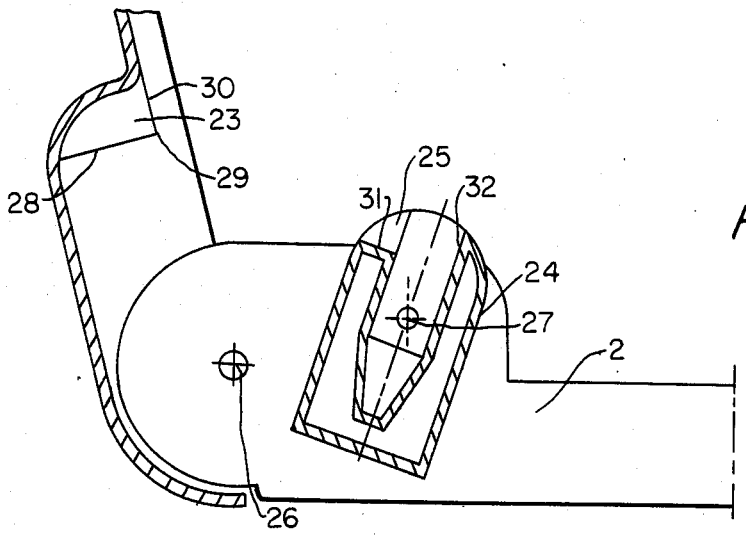
Figure 11:
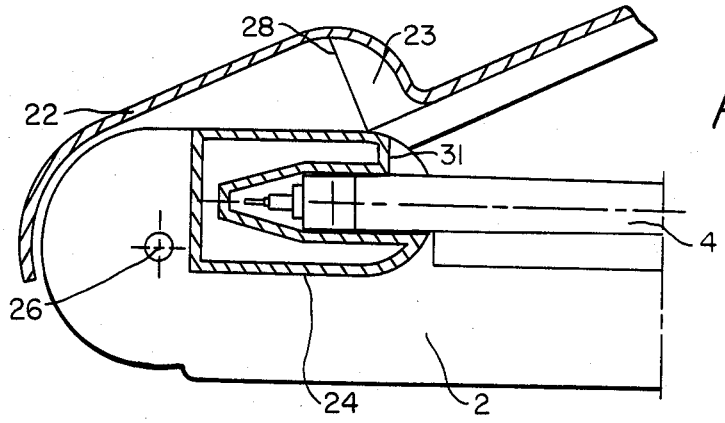

When the pen holder body 24 is in the empty or operational position (FIG. 10) and the lid element 22 then is moved around the hinge 26 from the open position (FIG. 8) towards the closed position, the protrusion 23 will enter the cutout 25, because in this position of the pen holder body 24 the distance between the hinge 26 and bottom 31 of the cutout 25 is smaller than the distance between the hinge 26 and the outside surface 28' of the protrusion 23, which faces the hinge 26. Thus, the outside surface 30 will contact the surface 32 of the pen holder body 24 which is opposite the cutout 25 (FIG. 10). The entire pen holder body then will be moved around the pen holder pivot axis 27 and assumes, together with the lid element 22, the closed position, illustrated in FIG. 9. In this closed position, the section 28' of the transverse surface 28 of the protrusion 23 opposite to the edge 29 will lie close to the transverse bottom 31 of the cutout 25 in the pen holder body 24, while the then axial surface 30 of the protrusion 23 rests on the axial surface 32 of the pen holder body 24. The lid element 22 thereby locks the receptacle 1 in a closed position.

If a tube writer 4 is in the pen holder body 24, and the pen holder body thereby has moved into the readiness position (FIG. 11), a movement of the lid element 22 from the open position (as in FIG. 8) towards the closed position, will cause the edge 29 of the protrusion 23 to come to rest upon the outer surface of the pen holder body 24 below the bottom 31 of the groove 25. This occurs because in the readiness position (FIG. 10) the distance between the bottom 31 of the cutout 25 and the hinge 26 of the lid element 22 is greater than the distance between the edge 29 of the protrusion 23 and the hinge 26. As the edge 29 of the protrusion 23 comes to rest upon the pen holder body 24, further movement of the lid element 22 is prevented, and the user cannot move the lid element 22 further down, into the closed position. This signals to the user that the tube writer 4 first should be removed from the pen holder body 24, and tightly closed by means of the associated cap. A removed tube writer thus closed can then be stored in a groove 5 (FIG. 1) and the lid element 22 can be brought into the closed position (FIG. 9).

While three preferred embodiments of the invention have been shown and described, the invention is to be limited solely by the scope of the appended claims.

We claim:

1. An improved pen holder device comprising at least one pen holder body with a longitudinal axis that is supported upon a generally horizontal support body for rotation between an operational position, which is slightly inclined from the vertical and a generally horizontal readiness position, whereby between the operational and readiness positions there exists an acute angle, the pen holder body comprising an upwardly open receptacle to accept axially an insertion of the lower end of a writing instrument, such as a tube writer, and transversely extending bearing shoulders that have a curved surface area portion and extend from opposite sides of the pen holder body, the support body further comprising a corresponding and opposed support surface means (10) to support each respective bearing shoulder and interact with each bearing shoulder (15) to allow low friction movement between the operational and the readiness positions substantially only as a result of a rotation of said curved surface area portion of a bearing shoulder (15) upon said support surface due to the position of the center of gravity of the pen holder body with respect to the support surface, wherein further, the center of gravity (21) of the pen holder body alone (3) is located vertically below the bearing shoulders (15) thereby tending to rotate the empty pen holder body towards the operational position, while the common center of gravity (20) of the pen holder body (3) with a writing instrument (4) inserted therein will be located vertically above the bearing shoulders (15) thereby tending to urge the pen holder and any inserted writing instrument towards the readiness position.

2. A pen holder device in accordance with claim 1, characterized in that the bearing supports (110) each have first and second support surfaces (111, 112) disposed at a distance from each other in the direction of the longitudinal axis of the pen holder body (103) in its readiness position, and in that bearing shoulder (115) has first and second bearing surfaces (116, 117) arranged at a distance from each other and adapted to interact with the corresponding first and second support surfaces (111, 112), wherein the second bearing surface (117) supports the pen holder body in a readiness position and is located closer to the upper end of the pen holder body (103) than the first bearing surface (116), which supports the pen holder body in an operational position.

3. A pen holder device in accordance with claim 2, characterized in that the bearing shoulder (115) has a substantially angular shape in transverse cross-section, and the first and second bearing surfaces (116, 117) are formed on free ends of said angular cross-section.

4. A pen holder device in accordance with claim 1, characterized in that the bearing support means further comprises a cutout (10, 110) open to the top, in the bottom of which one or more support surfaces (111, 112) for the bearing shoulder (15, 115) is provided.

5. A pen holder device in accordance with claim 2, characterized in that the bearing support means further comprises a cutout (10, 110) open to the top, in the bottom of which one or more support surfaces (12, 111, 112) for the bearing shoulder (15, 115) is provided.

6. A pen holder device in accordance with claim 3, characterized in that the bearing support means further comprises a cutout (10, 110) open to the top, in the bottom of which one or more support surfaces (12, 111, 112) for the bearing shoulder (15, 115) is provided.

7. A pen holder device in accordance with claim 2, characterized in that the support surfaces (111, 112) for the bearing shoulder (115) are separated from each other by a raised portion (113) in the bottom of the cutout.

8. A pen holder device in accordance with claim 3, characterized in that the support surfaces (111, 112) for the bearing shoulder (115) are separated from each other by a raised portion (113) in the bottom of the cutout.

9. A pen holder device according to claim 1, characterized in that a stop pin (18; 118) is provided at the lower end of the pen holder body (3; 103), which in the operational position and readiness positions respectively touches a limiting surface (6, 7; 106, 107) that is provided on the support body (2; 102), and in that said support body further comprises means to allow the stop pin (18; 118) to be moved out of the readiness position by means of movement of the bearing shoulders (15; 115) in the axial direction of the pen holder body (3; 103) and a removal from the support body (2; 102) out of a cutout (9; 109) in the support body (2; 102), which is open to the top.

10. A pen holder device according to claim 2, characterized in that a stop pin (18; 118) is provided at the lower end of the pen holder body (3; 103), which in the operational position and readiness positions respectively touches a limiting surface (6, 7; 106, 107) that is provided on the support body (2; 102), and in that said support body further comprises means to allow the stop pin (18; 118) to be moved out of the readiness position by means of movement of the bearing shoulders (15; 115) in the axial direction of the pen holder body (3; 103) and a removal from the support body (2; 102) out of a cutout (9; 109) in the support body (2; 102), which is open to the top.

11. A pen holder device according to claim 3, characterized in that a stop pin (18; 118) is provided at the lower end of the pen holder body (3; 103), which in the operational position and readiness positions respectively touches a limiting surface (6, 7; 106, 107) that is provided on the support body (2; 102), and in that said support body further comprises means to allow the stop pin (18; 118) to be moved out of the readiness position by means of movement of the bearing shoulders (15; 115) in the axial direction of the pen holder body (3; 103) and a removal from the support body (2; 102) out of a cutout (9; 109) in the support body (2; 102), which is open to the top.

12. A pen holder device according to claim 1, in which the support body further comprises a box-shaped receptacle having at least one holding area for a writing instrument which is proximate to a pen holder body, together with a lid element adapted to pivot between an open and a closed position upon said box-shaped receptacle through a hinge (26), having an axis disposed parallel to a pen holder pivot axis (27) and located on a side of the pen holder pivot axis (27) which is opposite the upwardly open pen receptacle end of a pen holder body wherein proximate to that open receptacle end the pen holder body has at least one cutout (25) on a side of the pen holder body (24) which faces towards the lid element (22), wherein further a protrusion (23) extends from the lid element (22) and lies in a plane that is perpendicular to the pen holder pivot axis (27) also is coplanar with the cutout (25), whereby said protrusion (23), with the lid element (22) closed, is adapted to extend through the associated cutout (25) and into the pen holder opening to engage a wall (32) of the pen holder body (24) located opposite the cutout (25).

13. A pen holder device according to claim 2, in which the support body further comprises a box-shaped receptacle having at least one holding area for a writing instrument which is proximate to a pen holder body, together with a lid element adapted to pivot between an open and a closed position upon said box-shaped receptacle through a hinge (26), having an axis disposed parallel to a pen holder pivot axis (27) and located on a side of the pen holder pivot axis (27) which is opposite the upwardly open pen receptacle end of a pen holder body wherein proximate to that open receptacle end the pen holder body has at least one cutout (25) on a side of the pen holder body (24) which faces towards the lid element (22), wherein further a protrusion (23) extends from the lid element (22) and lies in a plane that is perpendicular to the pen holder pivot axis (27) also is coplanar with the cutout (25), whereby said protrusion (23), with the lid element (22) closed, is adapted to extend through the associated cutout (25) and into the pen holder opening to engage a wall (32) of the pen holder body (24) located opposite the cutout (25).

14. A pen holder device according to claim 3, in which the support body further comprises a box-shaped receptacle having at least one holding area for a writing instrument which is proximate to the pen holder body, and a lid element having an open and a closed position pivotably is hinged to said box-shaped receptacle through a hinge (26), the axis around which the lid element (22) is pivotable being disposed parallel to a pen holder pivot axis (27) and located on that side of the pen holder pivot axis (27) away from the upwardly open pen receptacle writing element (4), wherein, further, at least one opening (25) is provided on a side of the upper end of a pen holder body (24) which faces towards the lid element (22), and a protrusion (23) extends from the lid element (22) in a plane that is perpendicular to the pen holder pivot axis (27) and contains the opening (25), whereby said protrusion (23), with the lid element (22) closed, will extend through the associated opening (25) and the pen holder opening and engages the all (32) of the pen holder body (24) located opposite the opening (25).

15. A pen holder device in accordance with claim 12, characterized in that the cutout opening (25) extends axially and is open at the top, and for the readiness position the distance between a transverse surface (31) of the pen holder body (25) and the hinge (26) of the lid element (22) is smaller than the distance between said hinge (26) and a transverse surface section (28') of the protrusion (23) which is oriented proximate and facing the transverse surface (31) of cutout (25), so that the protrusion engages a wall (32) of the pen holder receptacle opening, wherein, further, in the readiness position the distance between the transverse surface (31) of the cutout (25) and hinge (26) is greater than the distance between an edge (29) of the protrusion (23), and hinge (26), and in the operational position the distance between transverse surface (31) of the cutout (25) and hinge (26) is smaller than the distance between an outside transverse surface (28) of the protrusion (23) that is oriented towards the hinge (26) and that hinge.

16. A pen holder device in accordance with claim 13, characterized in that the cutout opening (25) extends axially and is open at the top, and for the readiness position the distance between a transverse surface (31) of the pen holder body cutout (25) and the hinge (26) of the lid element (22) is smaller than the distance between said hinge (26) and a transverse surface section (28') of the protrusion (23) which is oriented proximate and facing the transverse surface (31) of cutout (25), so that the protrusion engages a wall (32) of the pen holder receptacle opening, wherein, further, in the readiness position the distance between the transverse surface (31) of the cutout (25) and hinge (26) is greater than the distance between an edge (29) of the protrusion (23) and hinge (26), and in the operational position the distance between transverse surface (31) of the cutout (25) and hinge (26) is smaller than the distance between an outside transverse surface (28) of the protrusion (23) that is oriented towards the hnge (26), and that hinge.

17. A pen holder device in accordance with claim 1, characterized in that a plurality of pen holder bodies (3, 3', 3", 3'''; 24), pivotable independently from one another around a pen holder pivot axis (26), are provided in the support body (2).

18. A pen holder device in accordance with claim 2, characterized in that a plurality of pen holder bodies (3, 3', 3", 3'''; 24) pivotable independently from one another around a pen holder pivot axis (26), are provided in the support body (2).

19. A pen holder device in accordance with claim 3, characterized in that a plurality of pen holder bodies (3, 3', 3", 3'''; 24), pivotable independently from one another around a pen holder pivot axis (26), are provided in the support body (2).

* * * * *